United States Patent [19]

Albert

[11] 4,037,702

[45] July 26, 1977

[54] COIN OPERATED DISPENSING MACHINE

[75] Inventor: Jack Albert, Dayton, Ohio

[73] Assignee: American Lottery Equipment, Inc., Dayton, Ohio

[21] Appl. No.: 667,189

[22] Filed: Mar. 15, 1976

[51] Int. Cl.[2] ..... G07F 5/04

[52] U.S. Cl. ..... 194/93; 221/17

[58] Field of Search ..... 194/63, 4, DIG. 11, 194/1 D, DIG. 15, DIG. 9, 85, 2, 80, 93; 221/17-20, 276, 14, 272, 274, 124, 131, 310

[56] References Cited

U.S. PATENT DOCUMENTS

| | | | |
|---|---|---|---|
| 444,593 | 1/1891 | Hoyt | 221/310 X |
| 921,338 | 5/1909 | Asbury | 221/124 X |
| 2,596,230 | 5/1952 | Frick | 194/63 X |
| 2,870,939 | 1/1959 | Etes et al. | 221/17 X |
| 3,016,165 | 1/1962 | Casey et al. | 221/17 X |

*Primary Examiner*—Stanley H. Tollberg
*Attorney, Agent, or Firm*—Biebel, French & Nauman

[57] ABSTRACT

A coin operated dispensing machine is specially adapted for dispensing relatively large, thin tickets, usualy requiring a plurality of coins in payment therefor. The effective thickness of the tickets is increased by enclosing them in individual wallets or packets, the slide is fitted with a tongue and groove arrangement, a lock out arm rejects coins when the machine is sold out, and the coins are accurately counted to permit operation with only the proper count.

2 Claims, 10 Drawing Figures

COIN OPERATED DISPENSING MACHINE

BACKGROUND OF THE INVENTION

This invention relates to vending machines, and more particularly to a coin operated dispenser for relatively thin packets, such as individual tickets. More particularly, the invention provides improvements permitting the reliable dispensing of relatively large, thin tickets which, because of their dimensions, are unwieldy and thus difficult to dispense mechanically.

The prior art provides numerous examples of various vending machines and mechanisms. Examples include:

Long — U.S. Pat. No. 839,304 — Dec. 25, 1906
Stewart — U.S. Pat. No. 1,061,880 — May 13, 1913
Hanson — U.S. Pat. No. 1,349,953 — Aug. 17, 1920.
Lewis — U.S. Pat. No. 1,434,061 — Oct. 31, 1922
U.S. Pat. No. 1,688,821
Leis et al — U.S. Pat. No. 2,058,700 — Oct. 27, 1936
Kaltenback — U.S. Pat. No. 2,263,040 — Nov. 18, 1941
Niewoehner — U.S. Pat. No. 2,444,747 — July 6, 1948
Foushee — U.S. Pat. No. 2,528,690 — Nov. 7, 1950
Schonthal — U.S. Pat. No. 3,708,087 — Jan. 2, 1973

However, this art fails to provide satisfactory dispensing of large size tickets, or uses mechanisms which are unnecessarily complicated and unduly expensive. Thus, while it might appear at first glance that larger size tickets, such as bus tickets, lottery tickets, and so on, could be dispensed simply by scaling up a machine such as a postage stamp dispeners, it has been found in practice that such an approach is unsatisfactory.

SUMMARY OF THE INVENTION

Briefly, the present invention provides an improved dispensing slide for a coin operated dispenser which permits individual tickets to be dispensed accurately and reliably one at a time. The improved slide is relatively simple and inexpensive in construction, and provides wide manufacturing tolerances so that it is well adapted to inexpensive mass production.

In the present invention the tickets are stacked vertically in a storage chute and are ejected one at a time from the bottom thereof by the reciprocating slide. Understandably, the slide must have a thickness which is about the same as the item which is being dispensed. Further, the slide must be restrained so that it always remains against the end of the table across which it slides at the bottom of the chute. Should its motion deviate slightly above the table, the slide's effective "thickness" would increase and it might engage more than one ticket.

The present invention therefore employs wallets or packets, which will be defined more thoroughly hereinafter with reference to the drawing, to hold the tickets individually. By enclosing the tickets in these wallets, their effective thickness and stiffness are greatly increased. This allows the thickness of the slide, and the permissible tolerances in connection therewith, to be increased accordingly.

The motion of the slide as it reciprocates is guided by a tongue located in a channel in the face of the table which faces the slide. Since these members are most economically manufactured from relatively thin sheet metal stampings, the depth of the channel and thickness of the tongue in the preferred embodiment are about the same as the thickness of the slide. As may be seen, therefore, there is a good chance that the tongue may jump out of the channel, causing the slide to malfunction. The present invention therefore provides a tongue and groove mechanism whereby the edges of the slide are grooved, the edges of the table, then, are fitted into the grooves and the slide is guided thereby.

In one preferred embodiment, the present invention is particularly well suited to the dispensing of lottery tickets. Many such tickets are priced at fifty cents apiece. However, since fifty cent pieces are relatively scarce at present, it is preferable to be able to operate such a device with two quarters. Of course, commercially available coin testing and accepting devices are available, but it is desirable to be able to test the coins individually, and then to tally two such coins reliably and inexpensively. The present invention permits this to be done in an uncomplicated manner which additionally assures that the dispensing machine will not overcharge the customer in the event that the customer inadvertently inserts too many coins.

After the coins are tested and found acceptable by the coin testing device, they are placed into a vertically inclined coin holding chute which stacks the coins in edge to edge fashion. The coin holding chute has a slot thereacross at a distance from the lower end of the chute which is equal to approximately the sum of the diameters of the coins to be received in correct payment. Thus, if the price of the ticket is 50 cents, the slot will be located at a distance from the lower end equal to approximately twice the diameter of a quarter. If the price is 75 cents the distance will be 3 times the diameter.

The lower end of the chute is normally open, and is blocked by a first blocking member to contain the coins and stack them in the chute. When the dispensing machine is operated, this blocking member is moved out of the way to release the coins so that they may fall from the chute into a collection box.

In order to be certain that the proper number of coins has been inserted, and to prevent the machine from scavaging additional coins beyond those required for the purchase, a second blocking member is moved into the slot in the chute when the machine is operated. This second blocking member separates the coins beneath from the coins above so that only the proper number may fall through the lower end of the chute when the first blocking member releases them for collection. The second blocking member also functions to assure that a sufficient number of coins have been inserted and to prevent operation of the dispenser if the proper number is lacking.

More specifically, the second blocking member is pivoted so that it may move upwardly somewhat as it enters the slot, and the slot is positioned so that the uppermost coin extends partially above the lower edge of the slot. When the proper number of coins is then stacked in the chute, the second blocking member attempts to move through the position occupied by the upper coin, causing the upper coin to cam the second blocking member up and over. In the absence of such a coin, the second blocking member attempts to move horizontally through this upper coin position. On the side of the slot is a stop which is positioned at the same height as this upper coin position. The stop halts movement of the second blocking member into the slot if and when the second blocking member begins to move through this upper coin position. However, when there is a coin in this position, it cams the second blocking member up and over this stop, permitting it to enter fully into the slot, and thus enabling operation of the dispensing machine.

When the last wallet is dispensed, the present invention provides a lockout to cause subsequently deposited coins to be rejected. In this way the dispenser will not accept money after it is sold out. Here again, the wallets in which the tickets are dispensed make it possible to provide an accurate and reliable lockout which at the same time is relatively simple and inexpensive. Otherwise it would be necessary to use a detector which was sensitive to the very small thickness of the tickets, and such a detector would require careful adjustment and might suffer undue wear over a period of time.

In the present case the detector is simply a long arm which is pivoted and spring biased to pass into the chute through an opening extending along the side thereof. As long as there are wallets within the chute they prevent the lower end of the arm from entering the chute through this opening. The end of the arm is positioned, however, so that when the last ticket is dispensed, the contents of the chute will fall below it, permitting the spring to swing the arm into the chute. As the arm swings into the chute, the opposite end of the arm is moved into a hole in the coin testing device. This hole is the usual provision for causing the coin tester to reject all coins supplied thereto. Thus, as soon as the last wallet is dispensed, the arm pivots and the end thereof opposite the chute is moved into the coin tester to intercept and reject coins which are subsequently inserted into the dispenser. Of course, when the arm is held outside the chute by the contents thereof, coins are permitted to be accepted in the usual manner.

In order to assure proper feeding of the wallets, a fairly heavy weight is placed on top of the stack to keep it compressed and to be certain that the wallets are moved or biased toward the dispensing slide. This weight therefore forms part of the contents of the wallet chute, and the lockout arm is adjusted to take this into account. More specifically, the end of the arm which enters the wallet chute after the last wallet is dispensed is positioned so that it can just pass over the top of the weight when the weight falls to the bottom of the chute following ejection of the last wallet.

This weight may have an appendage attached to it which, when the number of wallets is low and the weight moves down, triggers a mechanism indicating it is time to refill the supply of wallets in the chute. This mechanism may be a color bar mechanically pulled past a window in the front of the machine to show a different color when the supply of wallets runs low.

Finally, the slot through which the wallets are dispensed has spring fingers mounted therein which partially obstruct the slot. The ends of these fingers having sharpened edges which are turned partially in the direction in which the wallets normally move as they are dispensed through the slot. These fingers then yield to the wallets during normal dispensing thereof, but engage and cam into them if attempts are made to move them in the reverse direction. This also occurs if attempts are made to insert other articles through the slot into the chute, so that the fingers effectively prevent the insertion of objects which might otherwise be used to "milk" the dispensing machine.

It is therefore an object of the present invention to provide improvements in coin operated vending machines and dispensers for improved handling and dispensing of relatively large, thin, discrete packets such as tickets or wallets; an improved lockout for such a dispenser for causing coins to be rejected when the machine is emptied by sensing the contents of the storage chute with an arm which is permitted to enter the chute when the machine is emptied; which provides a tongue and groove arrangement to assure proper motion of the dispensing slide; which includes spring fingers to prevent improper access through the dispensing slot; which prevents operation of the dispenser until the proper number of coins has been received therein, and then causes these coins to cam a blocking member past a stop to permit operation of the dispenser; and to provide these improvements in an inexpensive, uncomplicated, durable configuration having wide tolerances and being well adapted to convenient mass production.

Other objects and advantages of the invention will be apparent from the following description, the accompanying drawings and the appended claims.

DESCRIPTION OF THE PREFERRED EMBODIMENT

Figure 1:
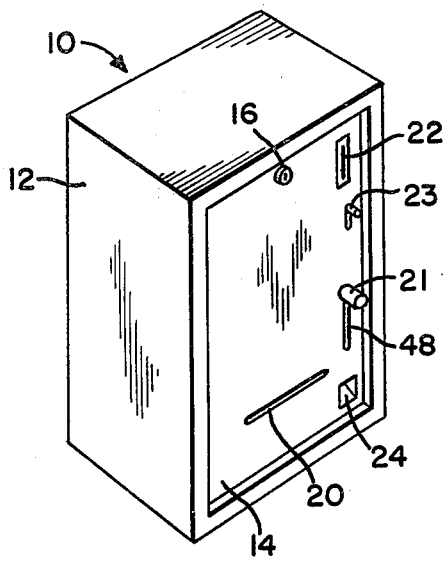
FIG. 1 is a perspective view of a coin operated dispenser incorporating the features of the present invention.
Figure 2:
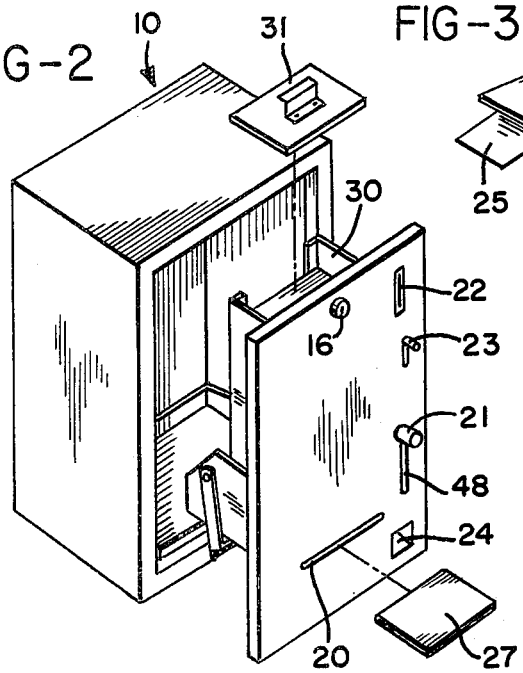
FIG. 2 is a perspective view similar to FIG. 1 illustrating removal of the dispenser from its cabinet.
Figure 3:
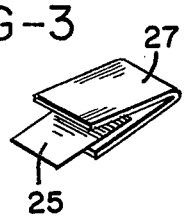
FIG. 3 illustrates a ticket and its wallet according to the present invention.
Figure 4:
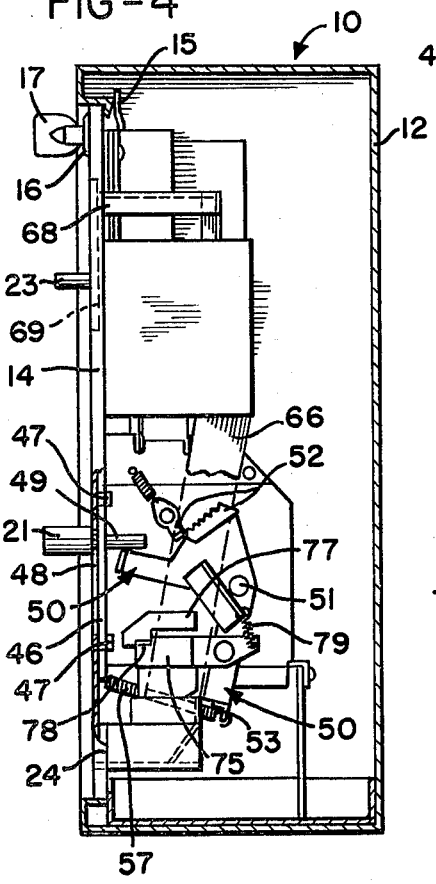
FIG. 4 is a section taken on line 4—4 of FIG. 5.
Figure 5:
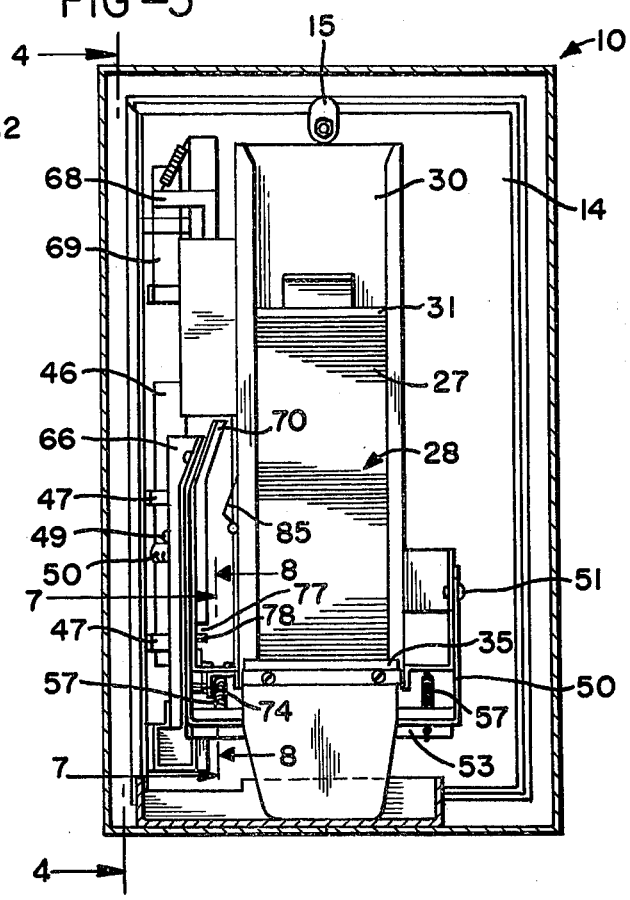
FIG. 5 is a back view of the dispenser mechanism.
Figure 6:
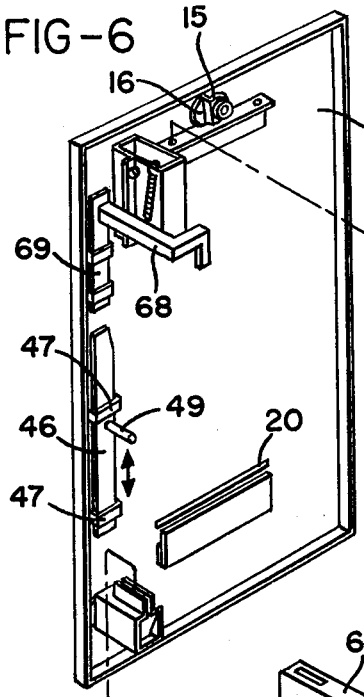
FIG. 6 is a perspective exploded view of the dispenser illustrating the various components thereof.

The coin operated dispenser 10 of the present invention is enclosed within a cabinet 12 having a front wall 14 which is releasably held within the cabinet by a retaining tab 15 carried on a lock 16 which is operated by a key 17. The dispenser 10 includes the usual dispensing slot or hole 20 for the articles which are being vended by the machine, and an operating knob 21 for actuating the dispenser after the proper coinage has been inserted in a coin slot 22. A bent coin release lever 23 causes rejected coins to fall to a coin return slot 24.

The individual tickets 25 which are to be dispensed are preferably enclosed within individual wallets 27 in order to increase the effective thickness of each item which is to be dispensed. This greatly facilitates handling of the commodities. Any suitable sized packet may be dispensed, of course, including individual tickets per se as well as those enclosed in wallets, However, the present invention is preferably used with packets which, although relatively thin, are substantially thicker than such tickets as lottery tickets, and the wallets are then used in order to assure proper operation of the dispenser. In fact, when such wallets are used it becomes possible to realize considerable economy in manufacturing tolerances and design simplifications, as particularly taught by the present invention.

The individual wallets are formed in a stack 28 which is placed vertically in a wallet chute 30, and a weight 31 is placed on the top of the stack 28. Weight 31 biases and moves the wallet stack 28 down to a table 34 at the bottom of the wallet chute 30.

Table 34 forms the end of chute 30 and has a dispensing slide 35 which is reciprocated back and forth across the table. Slide 35 is guided in part on table 34 by tongue 26 thereon which moves through a channel 37 in the upper face 38 of table 34, that is, the face of the table which faces the slide 35. The slide has a thickness about the same as one of the packets or wallets, so that when the slide is reciprocated backwardly and forwardly along channel 37, the leading edge 39 of the slide engages the wallets one at a time to move them outwardly through the dispensing slot 20. Slot 20 itself is dimensioned to permit only a single wallet or packet to pass through at a time. Slide 35 is guided by grooves 41 and 42 on each side of tongue 36. The edges of table 34 fit into these grooves to keep tongue 36 from jumping out of channel 37.

The dispenser 10 is actuated and slide 35 reciprocated by operating knob 21 guided upwardly and downwardly by a slide 46 captured in guides 47. Knob 21 moves through a slot 48 in the front wall 14 of the dispenser cabinet 12, and slide 46 is sufficiently long to assure complete coverage of slot 48. Thus slide 46 prevents unauthorized access to the interior of the dispenser through slot 48.

An extension 49 of knob 21 engages a large U-shaped lever member 50 to cause the lever to rotate on its mounting pivots 51. A conventional ratchet 52 engages the lever 50 to cause it to make a full cycle before it can be returned to its initial starting position. Thus vertical reciprocation of knob 21 causes a horizontal beam portion 53 of lever 50 to reciprocate backwards and forwards in a generally horizontal direction. Beam 53, in turn, is engaged by a yoke 55 (FIG. 7) attached to dispensing slide 35, so that the horizontal reciprocation of the lever beam 53 causes a corresponding reciprocation of slide 35 to dispense the wallets 27 individually through the dispensing slot 20. As is clear from the illustrations, knob 21 and its extension 49 are effective to move dispensing slide 35 from the front to the back of the dispenser 10. Forward (and hence, dispensing) movement of the slide is then provided by return springs 57 which are attached to lever 50 on either side of beam 53. It should be noted that the pivots 51, beam 53, return springs 57, and yoke 55 all cooperate to provide a uniform thrust for slide 35 which avoids uneven forces which might tend to twist or bind the slide in its movement.

Figure 7:
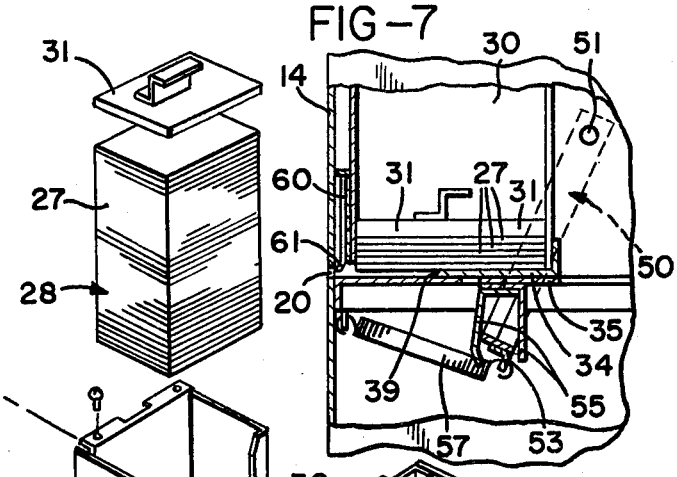
FIG. 7 is a fragmentary view, partly in section, taken in the direction of the view line7—7 shown in FIG. 5.
Figure 7:
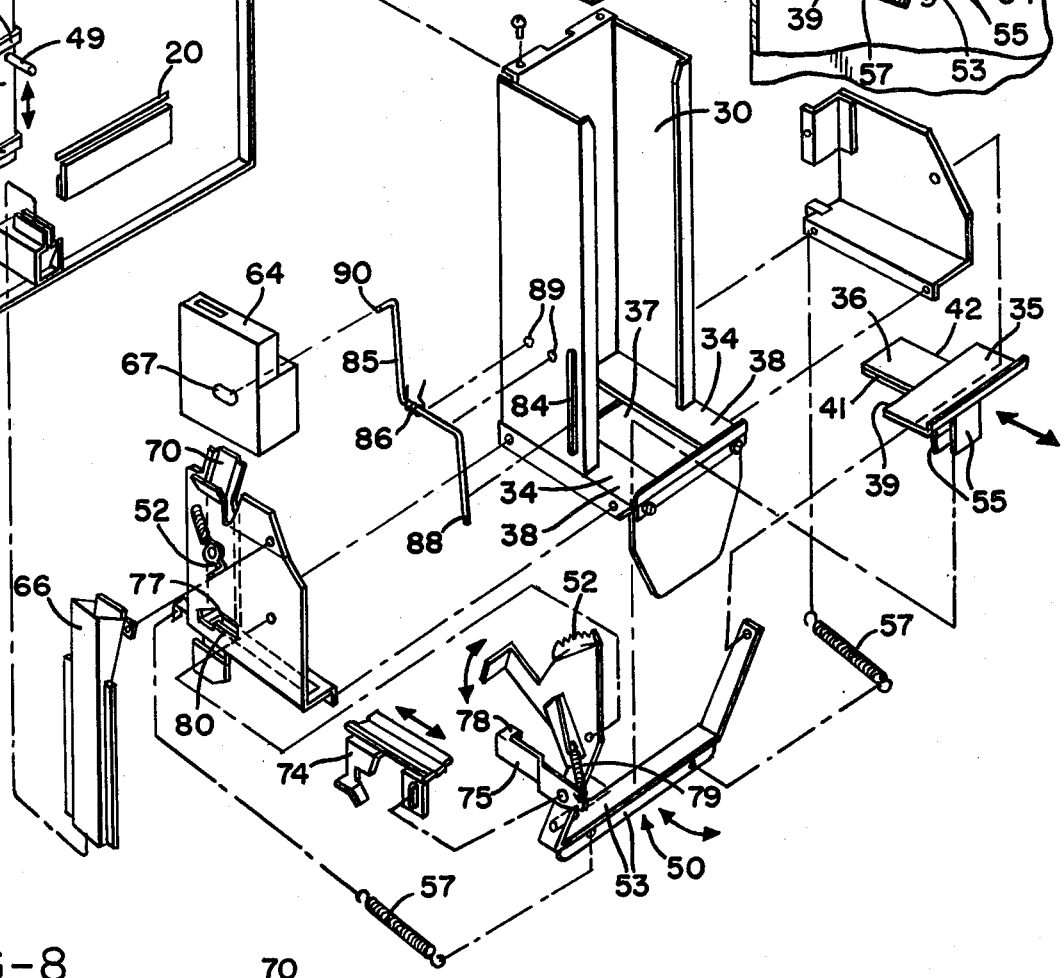

As illustrated in FIG. 7, dispensing slot 20 is partially obstructed by spring fingers 60 which have sharpened edges 61 which are turned partially outwardly, in the direction in which the wallets 27 move as they are dispensed through the slot 20 by the leading edge 39 of slide 35. The finger edges 61 thus engage the wallets but yield to them as they are individually dispensed. However, if an attempt is made to move something such as a wallet or another article in the reverse direction into the slot, it will be engaged by the finger edges, which will cam into the article and prevent such reverse movement into the chute 30 through the slot 20. This prevents "milking" the machine by the insertion of some foreign object.

When coins are inserted through coin slot 22 they are tested by a conventional coin testing device 64. If found unacceptable, they are returned to the coin return slot 24 through a coin return chute 66. Coin tester 64 also has a conventional coin rejector opening 67 which causes all coins to be rejected into chute 66 when some foreign object, such as a rod, is inserted into the opening 67. The bent coin release lever 23 operates tester 64 through an arm 68, and is guided for movement by an elongated slide 69 similar in design and function to slide 46.

Figure 8:
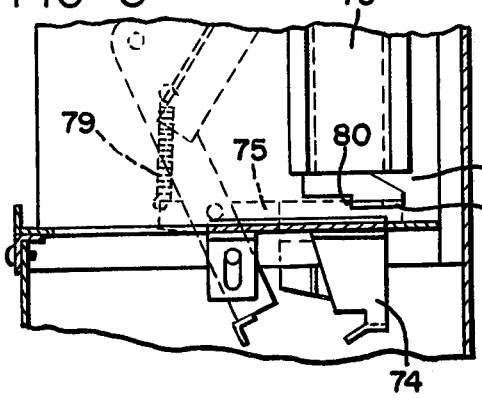
FIG. 8 is a fragmentary section on the line 8—8 of FIG. 5, with parts omitted for clarity of illustration.
Figure 9:
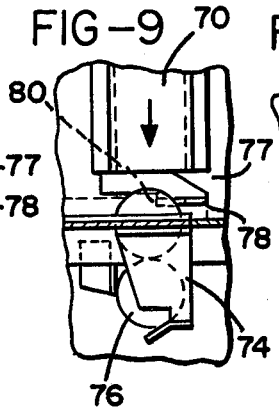
FIG. 9 is a view of a portion of the mechanism shown in FIG. 8, illustrating the reception and holding of two coins for enabling operation of the dispenser.
Figure 10:
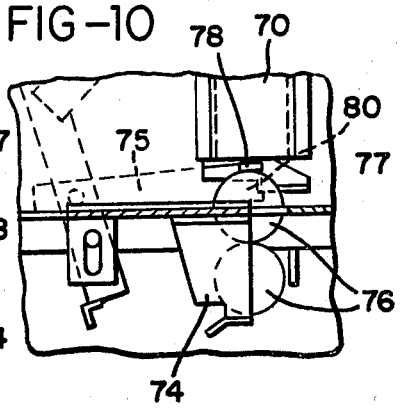
FIG. 10 is a moved view in accordance with FIGS. 8 and 9, illustrating the operation of the coin handling mechanism and associated lock during normal operation of the dispenser.

Coins which are found acceptable are diverted by tester 64 into an inclined coin holding chute 70 which receives and contains the coins therein, and is open at both ends thereof. In the preferred embodiment chute 70 is generally vertical, and includes means for enabling operation of the dispenser when a predetermined number of acceptable coins have been received in the chute. Thus, and with parricular reference to FIGS. 6 and 8–10, a first blocking member 74 and a second blocking member 75 are each attached to lever 50 for horizontal reciprocating movement therewith. The first blocking member 74 normally blocks the lower end of chute 70 to contain the coins therein, but moves out of the way to release the coins for collection from chute 70 when the dispenser 10 is operated by knob 21. In FIGS. 8–10 the near side of the lower portion of chute 70 has been omitted so that the operation of the first blocking member 74 may be seen. In FIG. 10, lever 50 has been moved approximately half way, causing the first blocking member 74 to move half way toward the position in which it will release the coins 76 which it is holding.

A slot 77 is provided across chute 70 at a distance from first blocking member 74 equal to approximately the sum of the diameters of the coins to be counted in each operation of the dispenser. In the illustration, two coins are required to purchase each ticket 25, so slot 77 is positioned at approximately two coin diameters from the first blocking member 74. The second blocking member 75 is normally positioned outside slot 77 but is moved by lever 50 into this slot as the machine is operated A tab 78 on member 75 thus enters the chute 70 through slot 77 to separate the coins beneath from those above. Tab 78 thereby prevents extra coins which may be in the chute from moving downwardly when the first blocking member 74 unblocks the lower end of chute 70 as the dispenser is operated.

A spring 79 causes the second blocking member 75 to engage the edge of slot 77, so that tab 78 will be biased toward movement into the slot through the position normally occupied by the uppermost of the coins required for operation of the dispenser 10. As illustrated, tab 78 thus tries to go where the second coin is being held. If there is no such coin present, tab 78 will then begin to move through this uppermost coin position, and it will be engaged and stopped by a stop ledge 80 on slot 77. This, in turn, will arrest further movement of lever 50, preventing operation of the dispenser 10.

On the other hand, if the uppermost coin is present, spring 79 will bias tab 78 toward this coin. The upper edge of the coin will cam tab 78 up and over the stop ledge 80 to permit the second blocking member 75 and tab 78 to enter fully into slot 77, permitting normal operation of the dispenser 10. At the end of the cycle, the first blocking member 74 returns to catch additional coins, and the second blocking member 75 returns to permit these coins to pass slot 77.

When the last wallet 27 and ticket 25 are sold, the dispenser 10 should then reject any further coins which might be deposited. An opening 84 is therefore provided near the bottom of wallet chute 30 through which a lockout arm 85 may pass to enter the chute under the influence of a spring 86. Normally the lower end 88 of arm 85 is abutted against the contents of chute 30 when it contains wallets 27 to be dispensed. Thus the wallets 27 and the weight 31 prevent the lower end 88 of arm 85 from entering the chute, but fall below the end 88 when the chute is emptied of wallets 27. When thus emptied, end 88 is moved into the chute by spring 86. Movement of end 88 of arm 88 into the chute, in turn, causes the arm to pivot on pivot tabs 89 so that the upper end 90 of arm 85 enters the coin rejecter opening 67 of the coin tester 64. Thus the uppper end 90 of arm 85 is moved to intercept and reject coins from the ticket dispenser when the lower end 88 of the arm is moved into the chute 30 through opening 84. When chute 30 contains tickets or wallets, however, upper end 90 of the arm 85 does not interfere with operation of coin tester 64, so that the tester is permited to accept coins in normal fashion.

While the form of apparatus herein described constitutes a preferred embodiment of this invention, it is to be understood that the invention is not limited to this precise form of apparatus, and that changes may be made therein without departing from the scope of the invention.

What is claimed is:

1. An interlock for a coin operated dispenser for preventing operation thereof until a predetermined number of coins of predetermined size are received therein, for enabling a single operation thereof when such coins are received, for collecting the predetermined number of coins, and for holding additional received coins and accepting them in the same number for each operation of the dispeners, comprising:

a. an inclined holding chute for receiving and containing the coins therein, said holding chute being open at both ends thereof, b. a first blocking member for blocking the lower end of said chute to contain the coins therein, said first blocking member being movable to release the coins for collection from said chute when the dispenser is operated, c. means forming a slot across said holding chute at a distance from said first blocking member equal to approximately the sum of the diameters of the predetermined number of coins to be received therein, d. a second blocking member movable into said slot in said chute when the dispenser is operated to separate the coins beneath from those above said slot and to prevent those above from moving downwardly through said chute as said first blocking member unblocks the lower end thereof during operation of the dispener, e. means biasing said second blocking member toward movement into said slot through the position occupied by the uppermost of the predetermined number of coins when they are stacked in said chute on said first blocking member, f. stop means for engaging and stopping movement of said second blocking member when it begins to move through said uppermost coin position, and g. means causing second blocking member to engage the upper edge of the uppermost coin, when present, to cause said uppermost coin to cam said second blocking member up and over said stop means to permit said second blocking member to enter fully into said slot when the predetermined number of said coins of predetermined size is present therebeneath in said chute.

2. A coin operated dispenser for thin, discrete tickets, comprising:

a. a wallet for containing each ticket to increase the effective thickness thereof, b. a chute within the dispenser for stacking said wallets therein, c. a dispensing slide for dispensing said wallets from said chute, d. a table forming the end of said chute, e. means forming a dispensing slot through the side of said chute adjacent said table at the end thereof, said dispensing slot being dimensioned to permit a single packet to pass therethrough, f. said dispensing slide having about the same thickness as one of said wallets and being mounted for reciprocation back and forth across said table toward and away from said slot, g. a weight for biasing the stack of wallets toward said dispensing slide, said slide thereby engaging said wallets one at a time and dispensing them through said slot as said slide is reciprocated back and forth and said weight moves said wallets successively onto said table, h. said table including means forming a channel in the face thereof facing said slide, said channel extending toward and away from said slot, i. said slide having a tongue thereon located in said table channel for guiding the movement of said slide as it reciprocates across said table, j. grooves formed along each edge of said tongue and engaging said table to hold said tongue in said channel, k. means forming an opening in the side of said chute, l. an arm passable into said chute through said chute opening and having a first end which may be abutted against the contents of said chute when it contains wallets to be dispensed, said chute contents preventing said first end of said arm from entering said chute when it contains said wallets, and said first end of said arm being movable into said chute when it is emptied of said wallets, m. a spring for biasing said arm against the contents of said chute and for moving said first end thereof into said chute when emptied of said wallets, n. said arm having a second end which is operatively connected to intercept and reject coins from the ticket dispenser when said first end of said arm is moved into said chute, and to permit coins to be accepted by the ticket dispenser when said first end of said arm is not in said chute.

o. spring fingers partially obstructing said slot and having sharpened edges turned partially in the direction in which said wallets move as they are dispensed through said slot, said finger edges engaging said wallets and yielding thereto during dispensing thereof, and engaging and camming into said wallets or other articles which are pressed in the opposite direction in said slot to prevent reverse movement thereof into the chute through said slot, p. an inclined holding chute for receiving and containing coins therein, said holding chute being open at both ends thereof, q. a first blocking member for blocking the lower end of said chute to contain the coins therein, said first blocking member being movable to release the coins for collection from said chute when said dispensing slide is reciprocated, r. means forming a holding chute slot across said holding chute at a distance from said first blocking member equal to approximately the sum of the diameters of the predetermined number of coins to be received therein, s. a second blocking member having a tab movable into said holding chute slot when said dispensing slide is reciprocated to separate the coins beneath from those above said slot and to prevent those above from moving downwardly through said chute as said first blocking member unblocks the lower end thereof, t. a spring biasing said second blocking member and said tab toward movement into said holding chute slot through the position occupied by the uppermost of the predetermined number of coins when they are stacked in said chute on said first blocking member, u. a stop ledge on said holding chute slot for engaging and stopping movement of said second blocking member tab when it begins to move through said uppermost coin position, and v. means causing said second blocking member tab to engage the upper edge of the uppermost coin, when present, to cause said uppermost coin to cam said tab up and over said stop ledge to permit said second blocking member and tab to enter fully into said slot when the predetermined number of said coins of predetermined size is present therebeneath in said chute.

* * * * *